US007188907B1

(12) United States Patent
Lai

(10) Patent No.: US 7,188,907 B1
(45) Date of Patent: Mar. 13, 2007

(54) ARMREST ASSEMBLY HAVING A POSITION ADJUSTING FUNCTION

(76) Inventor: Yu-Shan Lai, 4F-3, No. 506, Freedom Rd., Gia Yi (TW)

( * ) Notice: Subject to any disclaimer, the term of this patent is extended or adjusted under 35 U.S.C. 154(b) by 0 days.

(21) Appl. No.: 11/136,676

(22) Filed: May 24, 2005

(51) Int. Cl.
*A47C 7/54* (2006.01)

(52) U.S. Cl. ..... 297/411.35; 297/411.37

(58) Field of Classification Search ..... 297/411.35, 297/411.37, 411.38, 115, 116; 248/118, 118.5, 248/118.1
See application file for complete search history.

(56) References Cited

U.S. PATENT DOCUMENTS 5,884,974 A * 3/1999 Bergsten et al. ..... 297/411.35
5,975,640 A * 11/1999 Chen ..... 297/411.37
6,045,191 A * 4/2000 Piretti ..... 297/411.37
6,106,070 A * 8/2000 Ritt et al. ..... 297/411.35
6,302,486 B1 * 10/2001 Lamart et al. ..... 297/411.37
6,502,904 B1 * 1/2003 Hansen ..... 297/411.35
2005/0146192 A1 * 7/2005 Trego et al. ..... 297/411.37

* cited by examiner

*Primary Examiner*—Peter M. Cuomo
*Assistant Examiner*—Sarah B. McPartlin
(74) *Attorney, Agent, or Firm*—Alan D. Kamrath; Nikolai & Mersereau, P.A.

(57) ABSTRACT

A armrest assembly includes an upright armrest support, a support member mounted on the armrest support, a slide member movably mounted on the support member, and an armrest movably mounted on the slide member and movable toward a direction opposite to that of the slide member. The slide member is movable on the support member in the longitudinal direction, and the armrest is movable on the slide member in the transverse direction, so that the armrest is movable relative to the support member forward, backward, leftward and rightward. Thus, the armrest is movable relative to the support member in the two opposite directions so as to adjust the position of the armrest in a two-dimensional manner.

5 Claims, 6 Drawing Sheets

ARMREST ASSEMBLY HAVING A POSITION ADJUSTING FUNCTION

BACKGROUND OF THE INVENTION

1. Field of the Invention

The present invention relates to an armrest assembly, and more particularly to an armrest assembly for a chair.

2. Description of the Related Art

A chair comprises a stand, a seat mounted on the stand, and an armrest mounted on the seat. However, the conventional armrest has a fixed size and specification, so that the position of the armrest cannot be adjusted to fit requirements of different users, thereby greatly limiting the versatility of the armrest, and thereby causing inconvenience to the users.

SUMMARY OF THE INVENTION

The primary objective of the present invention is to provide an armrest assembly having a position adjusting function.

Another objective of the present invention is to provide an armrest assembly, wherein the armrest is movable relative to the support member in the two opposite directions so as to adjust the position of the armrest in a two-dimensional manner.

A further objective of the present invention is to provide an armrest assembly, wherein the slide member is movable on the support member in the longitudinal direction, and the armrest is movable on the slide member in the transverse direction, so that the armrest is movable relative to the support member forward, backward, leftward and rightward.

Further benefits and advantages of the present invention will become apparent after a careful reading of the detailed description with appropriate reference to the accompanying drawings.

DETAILED DESCRIPTION OF THE INVENTION

Figure 1:
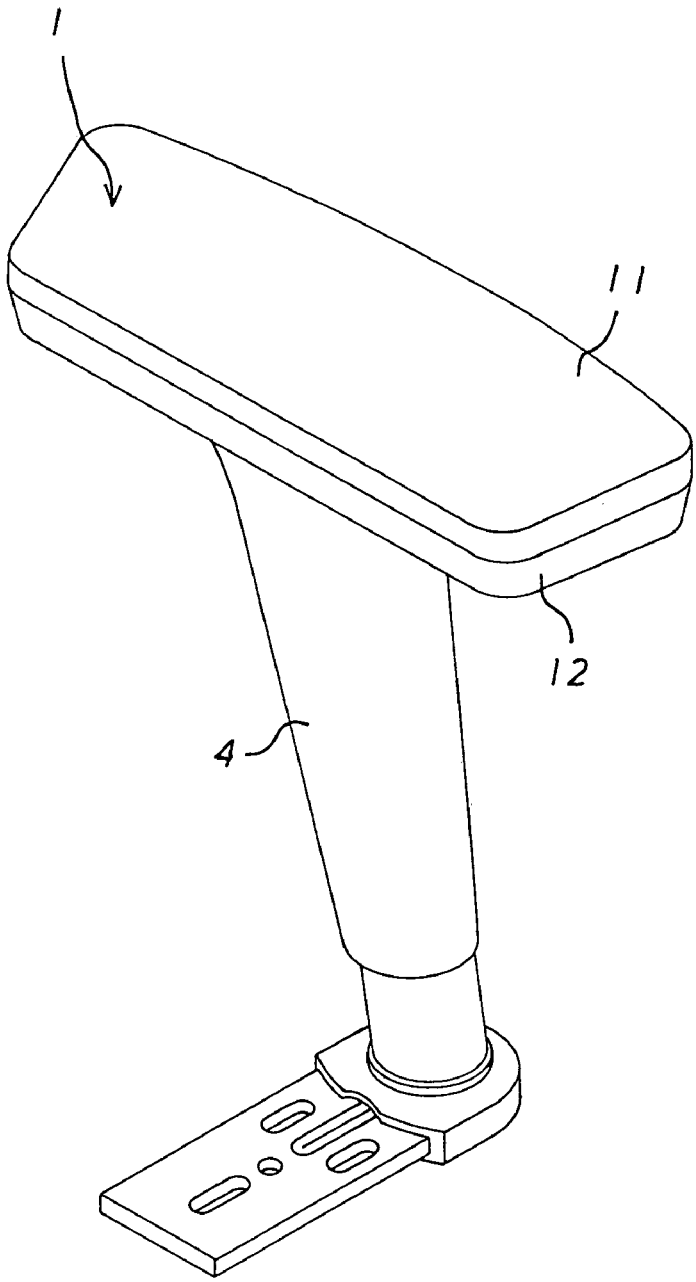
FIG. 1 is a perspective view of an armrest assembly in accordance with the preferred embodiment of the present invention.
Figure 2:
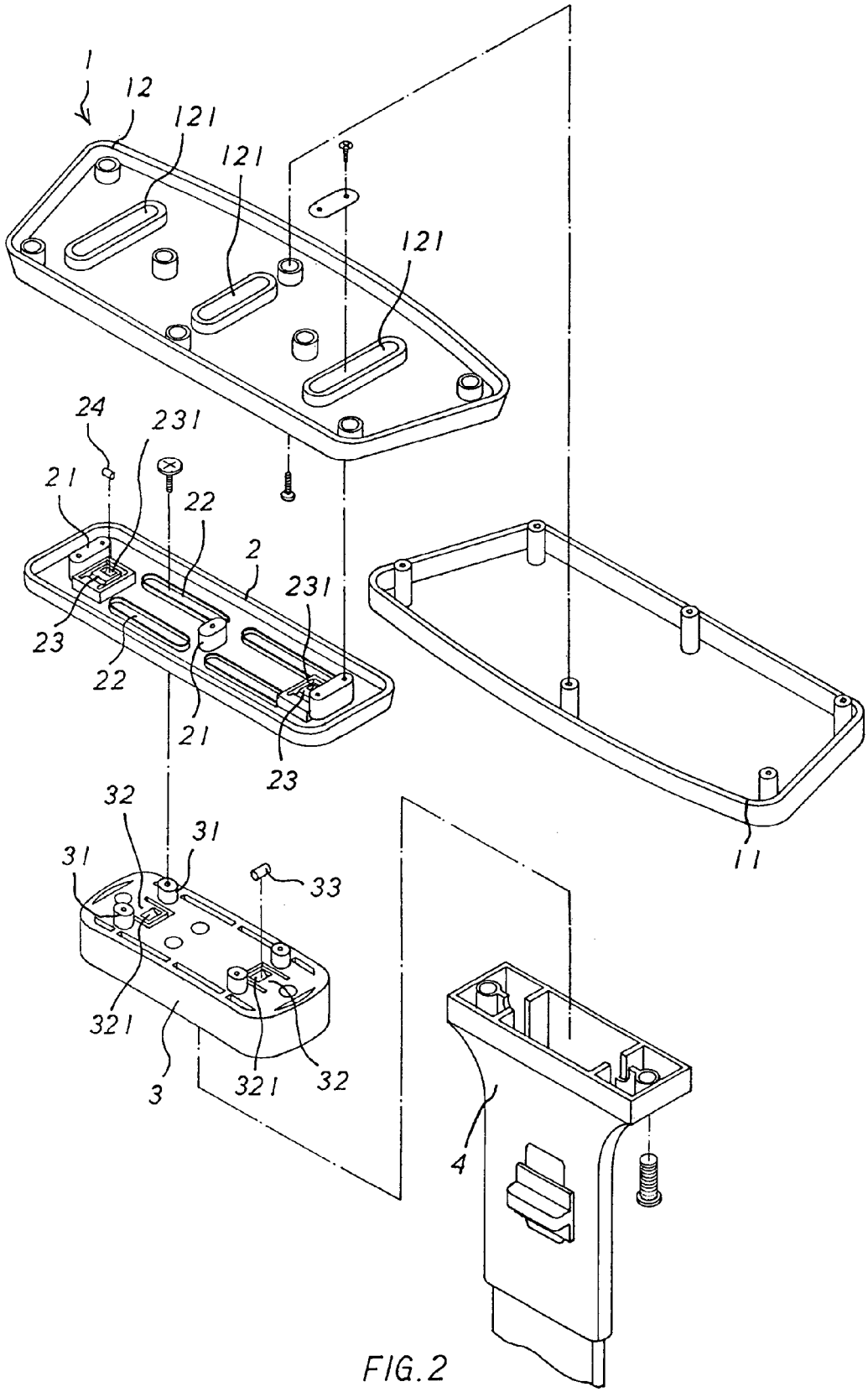
FIG. 2 is an exploded perspective view of the armrest assembly as shown in FIG. 1.
Figure 3:
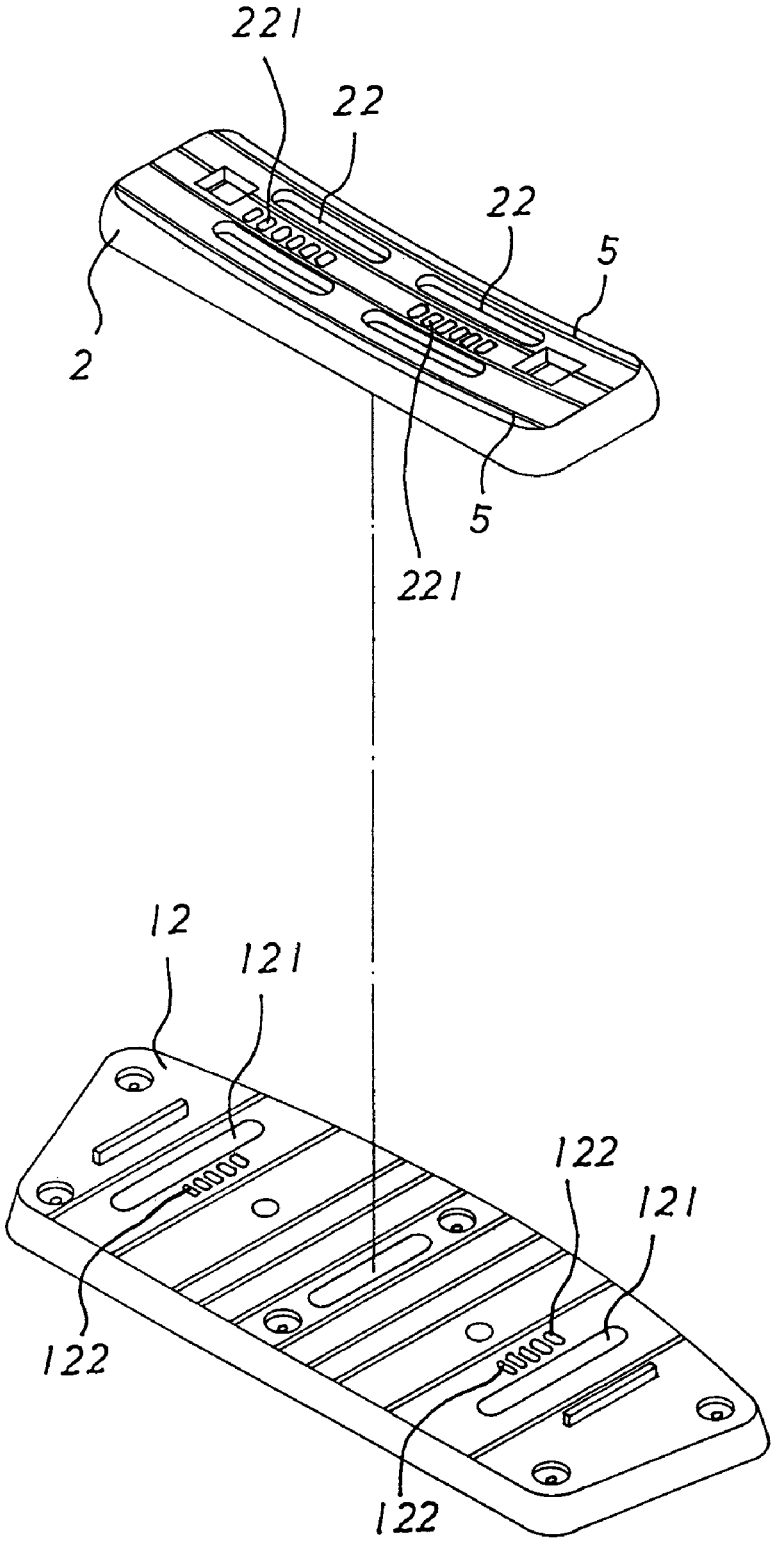
FIG. 3 is a partially exploded perspective view of the armrest assembly as shown in FIG. 1.

Referring to the drawings and initially to FIGS. 1–5, an armrest assembly in accordance with the preferred embodiment of the present invention comprises an upright armrest support 4, a support member 3 mounted on the armrest support 4, a slide member 2 movably mounted on the support member 3, and an armrest 1 movably mounted on the slide member 2 and movable toward a direction opposite to that of the slide member 2.

The armrest support 4 is height adjustable.

The support member 3 is secured on the armrest support 4 and has a top face formed with a plurality of longitudinally arranged guide posts 31 and provided with at least one hollow elastic plate 32 formed with an arc-shaped slot 321 to receive a roller 33.

The slide member 2 is formed with a plurality of longitudinally arranged guide slots 22, and the guide posts 31 of the support member 3 are slidably mounted in the guide slots 22 of the slide member 2 so that the slide member 2 is movably mounted on the support member 3. The slide member 2 has a bottom face formed with a plurality of longitudinally arranged arc-shaped positioning grooves 221, and the roller 33 of the elastic plate 32 of the support member 3 is detachably positioned in any one of the positioning grooves 221 of the slide member 2 so that the slide member 2 is detachably positioned on the support member 3. The slide member 2 has a top face formed with a plurality of transversely arranged slide posts 21 and provided with at least one hollow elastic plate 23 formed with an arc-shaped slot 231 to receive a roller 24.

The armrest 1 includes a lower armrest plate 12 movably mounted on the slide member 2, and an upper armrest plate 11 secured on the lower armrest plate 12. The lower armrest plate 12 of the armrest 1 is formed with a plurality of transversely arranged slide slots 121, and the slide posts 21 of the slide member 2 are slidably mounted in the slide slots 121 of the armrest 1 so that the armrest 1 is movably mounted on the slide member 2. The lower armrest plate 12 of the armrest 1 has a bottom face formed with a plurality of transversely arranged arc-shaped positioning grooves 122, and the roller 24 of the elastic plate 23 of the slide member 2 is detachably positioned in any one of the positioning grooves 122 of the armrest 1 so that the armrest 1 is detachably positioned on the slide member 2.

Figure 4:
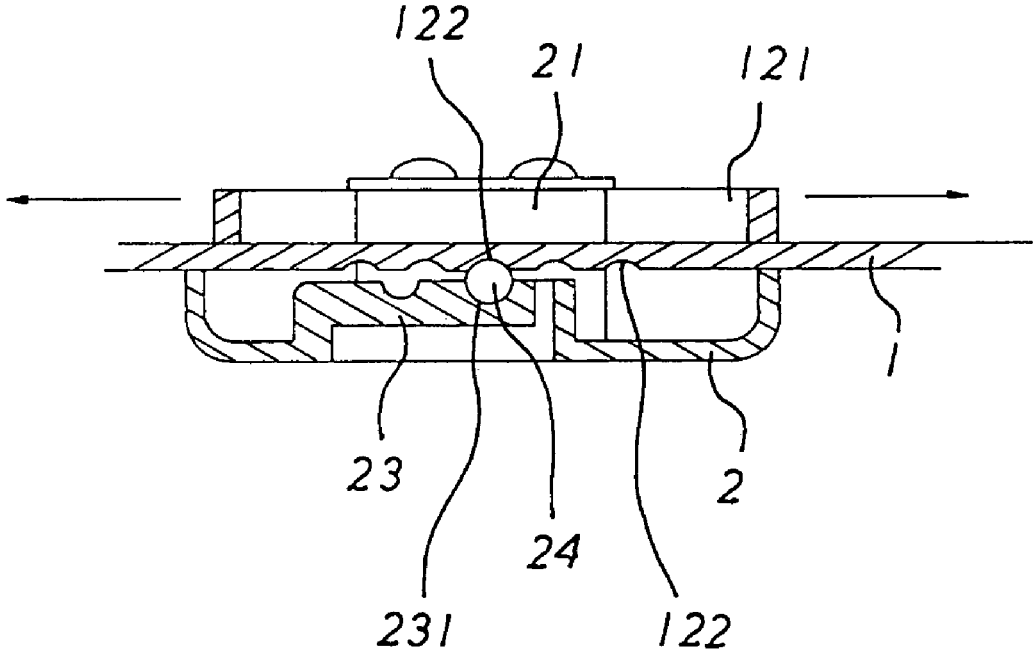
FIG. 4 is a plan cross-sectional view of the armrest assembly as shown in FIG. 1.

As shown in FIG. 4, the armrest 1 is movable on the slide member 2 so as to change the position of the armrest 1 relative to the slide member 2. At this time, the roller 24 of the elastic plate 23 of the slide member 2 is detachably positioned in any one of the positioning grooves 122 of the armrest 1 so that the armrest 1 is detachably positioned on the slide member 2.

Figure 5:
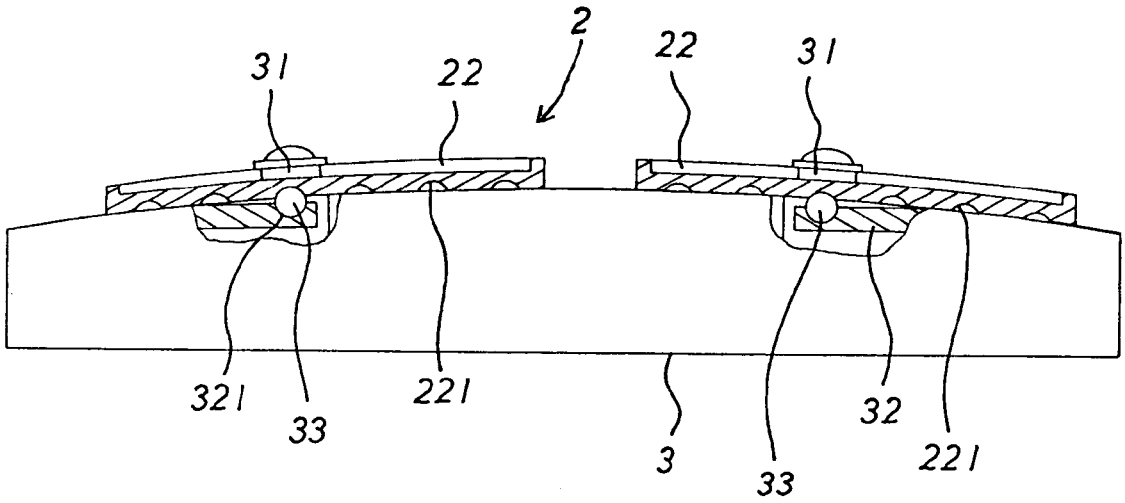
FIG. 5 is a plan cross-sectional view of the armrest assembly as shown in FIG. 1.

As shown in FIG. 5, the slide member 2 is movable on the support member 3 so as to change the position of the slide member 2 relative to the support member 3. At this time, the roller 33 of the elastic plate 32 of the support member 3 is detachably positioned in any one of the positioning grooves 221 of the slide member 2 so that the slide member 2 is detachably positioned on the support member 3.

Accordingly, the slide member 2 is movable on the support member 3 in the longitudinal direction, and the armrest 1 is movable on the slide member 2 in the transverse direction, so that the armrest 1 is movable relative to the support member 3 forward, backward, leftward and rightward. Thus, the armrest 1 is movable relative to the support member 3 in the two opposite directions so as to adjust the position of the armrest 1 in a two-dimensional manner.

In addition, the armrest 1, the slide member 2 and the support member 3 have contact faces formed with a plurality of elongated protruding strips 5 to reduce the friction, thereby facilitating movement of the armrest 1.

Figure 6:
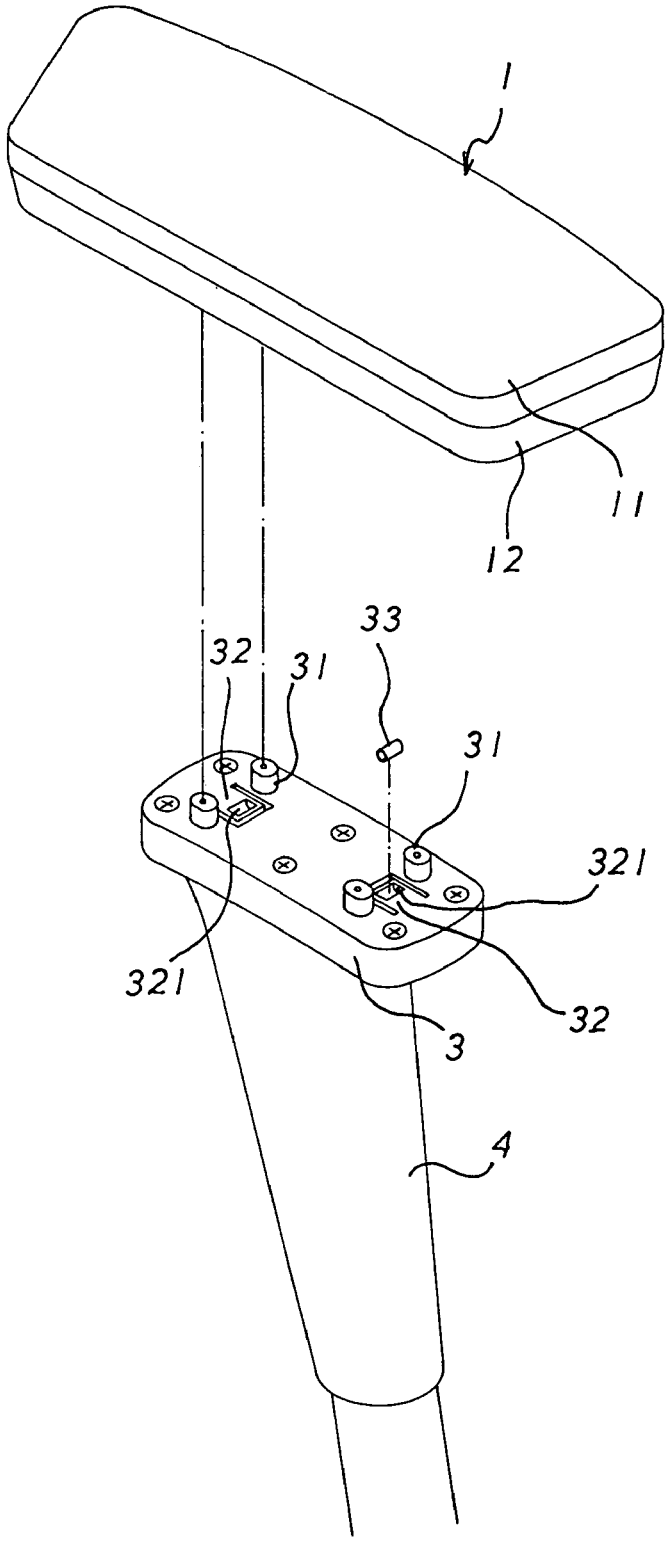
FIG. 6 is a partially exploded perspective view of an armrest assembly in accordance with another preferred embodiment of the present invention.

As shown in FIG. 6, the support member 3 is formed integrally on a top face of the armrest support 4.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An armrest assembly, comprising:

an upright armrest support;

a support member mounted on the armrest support;

a slide member movably mounted on the support member and movable relative to the support member in a first direction; and an armrest movably mounted on the slide member and movable relative to the slide member in a second direction perpendicular to the first direction; wherein:

the support member has a top face formed with a plurality of longitudinally arranged upwardly extending guide posts and provided with at least one hollow elastic plate formed with an arc-shaped slot to receive a roller which is partially protruded outward from the arc-shaped slot of the support member;

the slide member is formed with a plurality of longitudinally arranged elongated guide slots, and the guide posts of the support member are slidably mounted in the guide slots of the slide member so that the slide member is movably mounted on the support member;

the slide member has a bottom face formed with a plurality of longitudinally arranged arc-shaped positioning grooves each parallel with the guide slots, and the roller of the elastic plate of the support member is detachably positioned in any one of the positioning grooves of the slide member so that the slide member is detachably positioned on the support member;

the slide member has a top face formed with a plurality of transversely arranged upwardly extending slide posts and provided with at least one hollow elastic plate formed with an arc-shaped slot to receive a roller which is partially protruded outward from the arc-shaped slot of the slide member;

the armrest includes a lower armrest plate movably mounted on the slide member, and an upper armrest plate secured on the lower armrest plate;

the lower armrest plate of the armrest is formed with a plurality of transversely arranged elongated slide slots each perpendicular to the guide slots of the slide member, and the slide posts of the slide member are slidably mounted in the slide slots of the armrest so that the armrest is movably mounted on the slide member;

the lower armrest plate of the armrest has a bottom face formed with a plurality of transversely arranged arc-shaped positioning grooves each parallel with the slide slots, and the roller of the elastic plate of the slide member is detachably positioned in any one of the positioning grooves of the lower armrest plate of the armrest so that the armrest is detachably positioned on the slide member.

2. The armrest assembly in accordance with claim 1, wherein the armrest support is height adjustable.

3. The armrest assembly in accordance with claim 2, wherein the support member is formed integrally on a top face of the armrest support.

4. The armrest assembly in accordance with claim 1, wherein the support member is formed integrally on a top face of the armrest support.

5. The armrest assembly in accordance with claim 1, wherein the armrest, the slide member and the support member have contact faces having a periphery formed with a plurality of elongated protruding strips.

* * * * *